US008601653B1

(12) United States Patent
Agurcia et al.

(10) Patent No.: US 8,601,653 B1
(45) Date of Patent: Dec. 10, 2013

(54) CASKET COVER ASSEMBLY

(76) Inventors: Fernando Agurcia, San Antonio, TX (US); Marcela Agurcia, San Antonio, TX (US)

( * ) Notice: Subject to any disclaimer, the term of this patent is extended or adjusted under 35 U.S.C. 154(b) by 0 days.

(21) Appl. No.: 13/558,009

(22) Filed: Jul. 25, 2012

(51) Int. Cl.
*A61G 17/00* (2006.01)

(52) U.S. Cl.
USPC ..... 27/35; 27/2

(58) Field of Classification Search
USPC ..... 27/2, 12, 19, 20, 32, 33, 35; 52/128, 52/133, 138–142
See application file for complete search history.

(56) References Cited

U.S. PATENT DOCUMENTS

| | | | | | |
|---|---|---|---|---|---|
| 233,356 | A | * | 10/1880 | Keefer et al. | 27/33 |
| 524,824 | A | * | 8/1894 | Hiser | 5/627 |
| 1,065,579 | A | * | 6/1913 | Bentley | 27/35 |
| 1,681,337 | A | * | 8/1928 | Grund | 27/1 |
| 1,791,341 | A | * | 2/1931 | Bancroft | 27/32 |
| 1,833,547 | A | * | 11/1931 | Wollitz | 27/35 |
| 1,854,576 | A | * | 4/1932 | Blue | 292/107 |
| 1,898,939 | A | * | 2/1933 | Cohen | 27/35 |
| 2,007,119 | A | * | 7/1935 | Harris | 27/35 |
| 2,167,001 | A | * | 7/1939 | Oppenheim | 27/32 |
| 3,353,238 | A | * | 11/1967 | Sieloff | 27/7 |
| 3,574,906 | A | * | 4/1971 | Rittenhouse | 27/4 |
| 3,654,676 | A | * | 4/1972 | McHugh | 27/2 |
| 3,782,619 | A | * | 1/1974 | Dittbenner | 206/527 |
| 3,815,185 | A | * | 6/1974 | Owens | 27/3 |
| 4,041,582 | A | * | 8/1977 | MacDonald | 27/2 |
| 4,123,831 | A | * | 11/1978 | Covington | 27/2 |
| 4,174,556 | A | | 11/1979 | Richings | |
| 4,337,556 | A | | 7/1982 | Winburn et al. | |
| 4,780,940 | A | * | 11/1988 | Jay | 27/28 |
| 4,823,448 | A | | 4/1989 | Martin | |
| 5,481,785 | A | * | 1/1996 | Minton et al. | 27/27 |
| 6,385,824 | B1 | * | 5/2002 | Schwartz | 27/35 |
| 6,434,804 | B1 | * | 8/2002 | Cornet et al. | 27/2 |
| 7,472,462 | B1 | | 1/2009 | Parker et al. | |
| D622,475 | S | | 8/2010 | Pulver et al. | |
| 2011/0041302 | A1 | | 2/2011 | Bates | |

* cited by examiner

*Primary Examiner* — William Miller

(57) ABSTRACT

A casket shell assembly and method provide for covering an economical or plain casket with a reusable decorative shell. The assembly includes a casket and a shell. The shell has a perimeter wall, an open top, and an open bottom. The shell receives the casket through the open top. A lip coupled to the perimeter wall of the shell supports the casket when the casket is inserted into the shell. A lid is coupled to the perimeter wall selectively covering the open top of the shell when the lid is in a closed position. A plurality of straps is positioned in the shell extending between the shell and the casket. Each of the straps has opposite free ends extendable through the open top of the shell for facilitating lifting of the casket from the shell.

12 Claims, 6 Drawing Sheets

CASKET COVER ASSEMBLY

BACKGROUND OF THE DISCLOSURE

Field of the Disclosure

The disclosure relates to casket devices and more particularly pertains to a new casket device for temporarily covering an economical or plain casket with a reusable decorative shell.

SUMMARY OF THE DISCLOSURE

An embodiment of the disclosure meets the needs presented above by generally comprising a casket and a shell having a perimeter wall, an open top, and an open bottom. The shell receives the casket through the open top. A lip is coupled to and extends inwardly from an inner surface of the perimeter wall of the shell whereby the lip supports the casket when the casket is inserted into the shell through the open top of the shell. A lid is coupled to the perimeter wall selectively covering the open top of the shell when the lid is in a closed position. A plurality of straps is positioned in the shell extending between the shell and the casket. Each of the straps has opposite free ends extendable through the open top of the shell for facilitating lifting of the casket from the shell.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
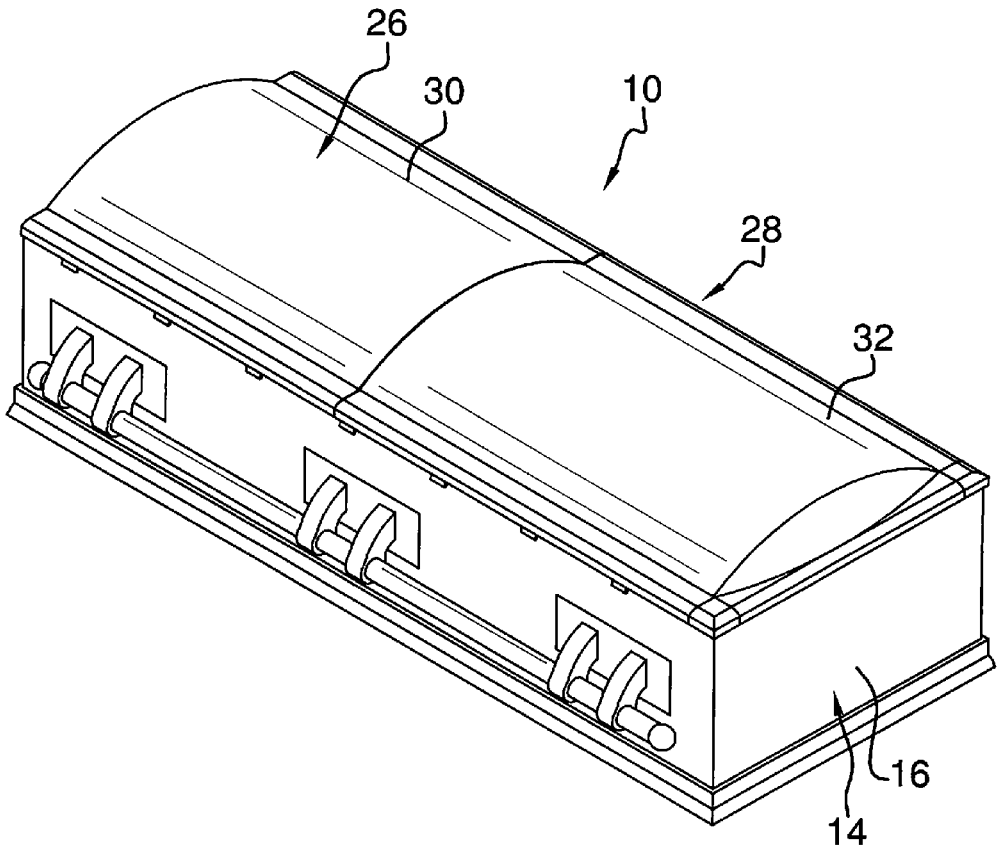
FIG. 1 is a top front side perspective view of a casket shell assembly and method of enhancing casket appearance according to an embodiment of the disclosure.
Figure 2:
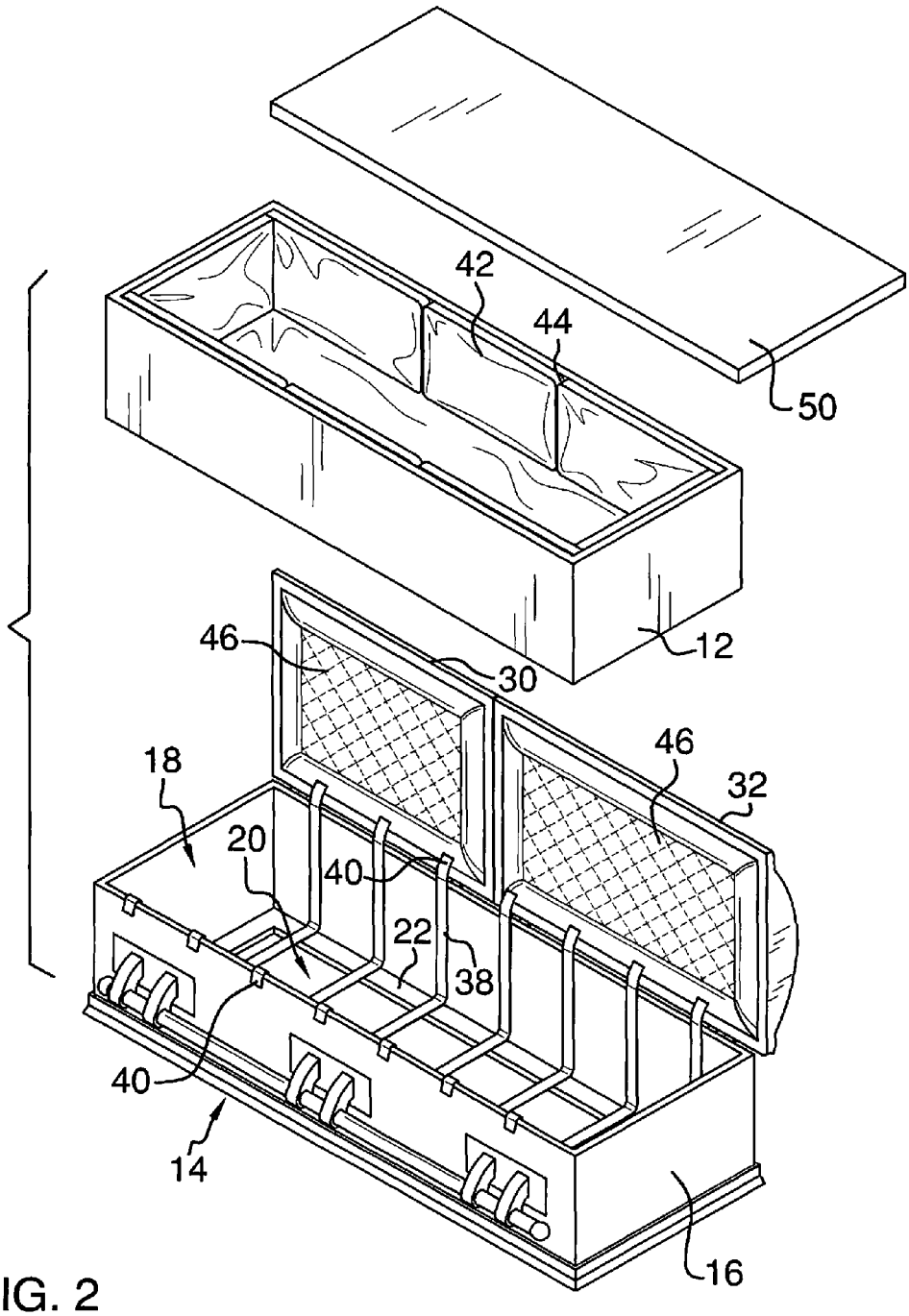
FIG. 2 is a partially exploded top front side perspective view of an embodiment of the disclosure.
Figure 3:
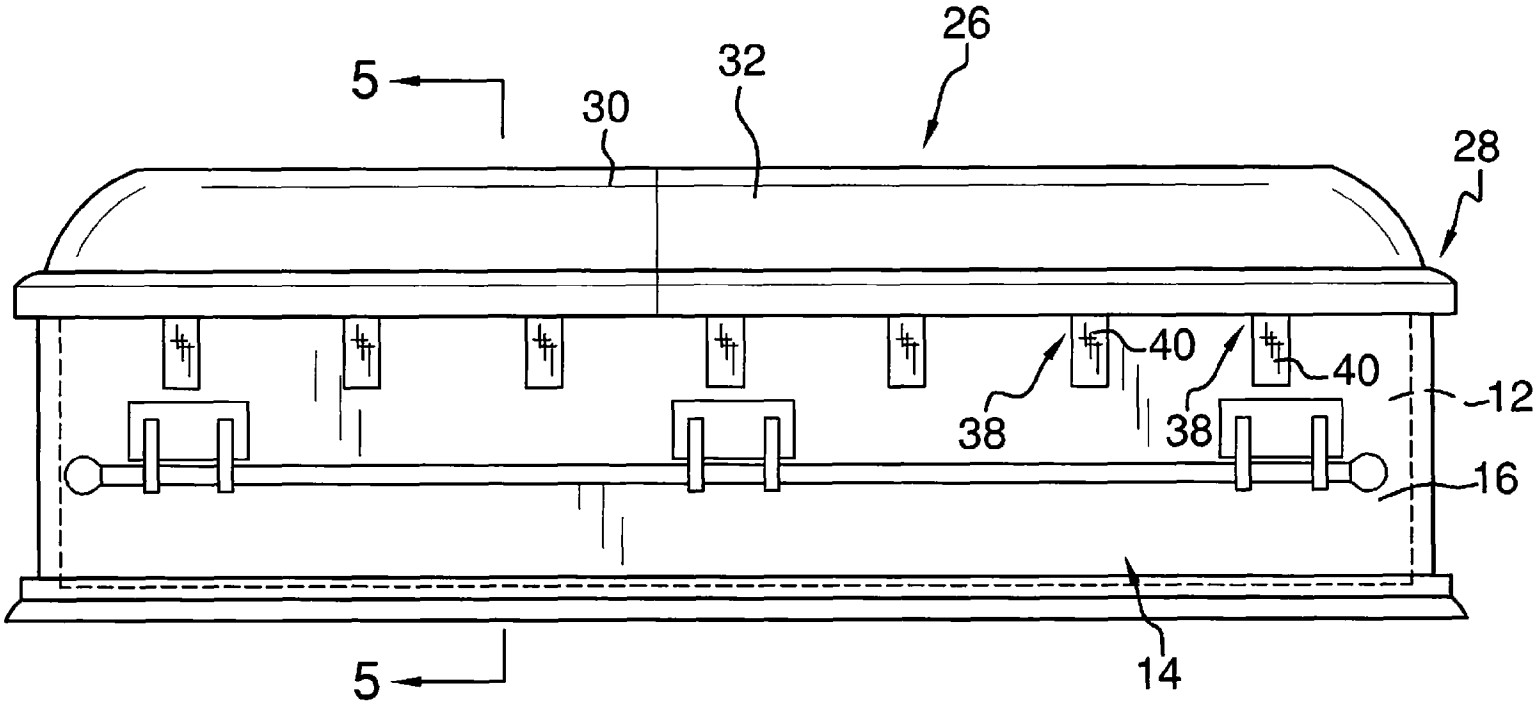
FIG. 3 is a front view of an embodiment of the disclosure.
Figure 4:
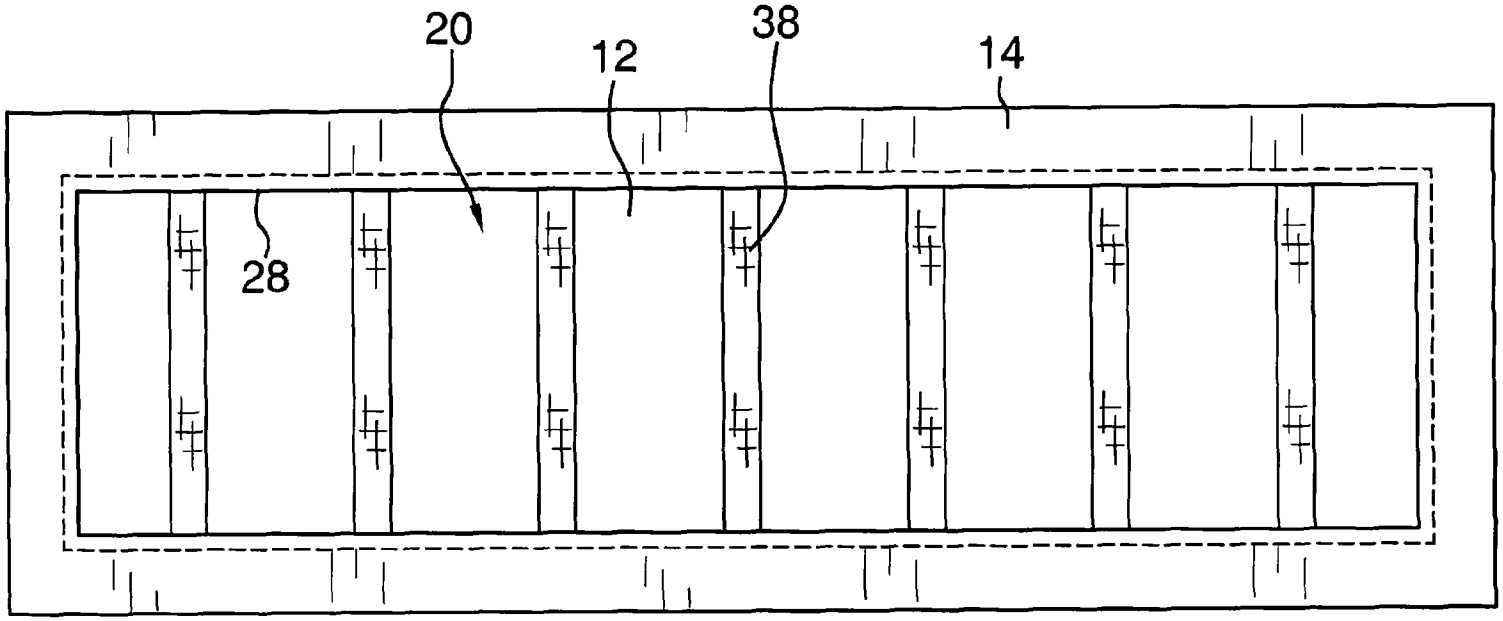
FIG. 4 is a bottom view of an embodiment of the disclosure.
Figure 5:
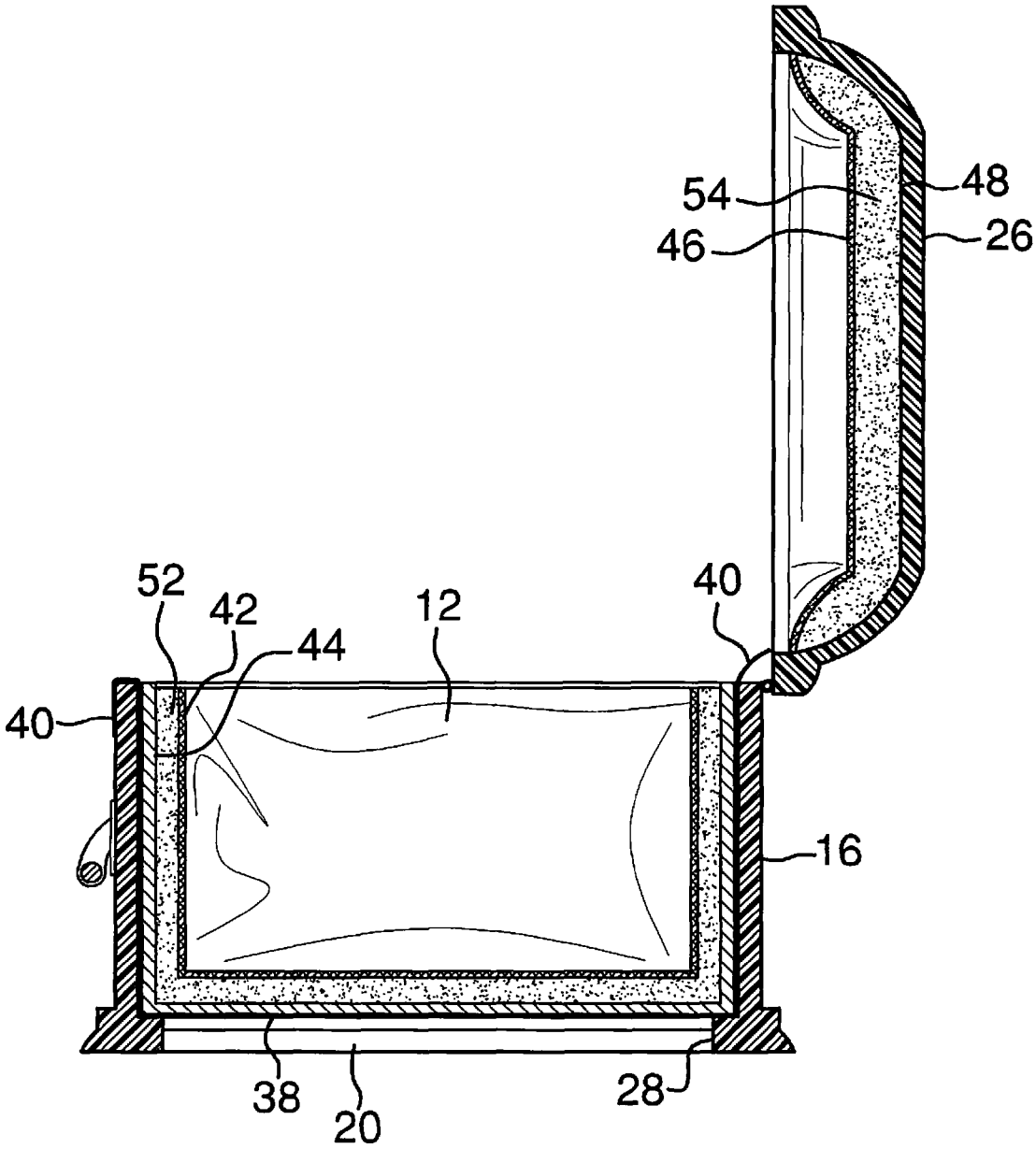
FIG. 5 is a cross-sectional view of an embodiment of the disclosure taken along line 5-5 of FIG. 3.
Figure 6:
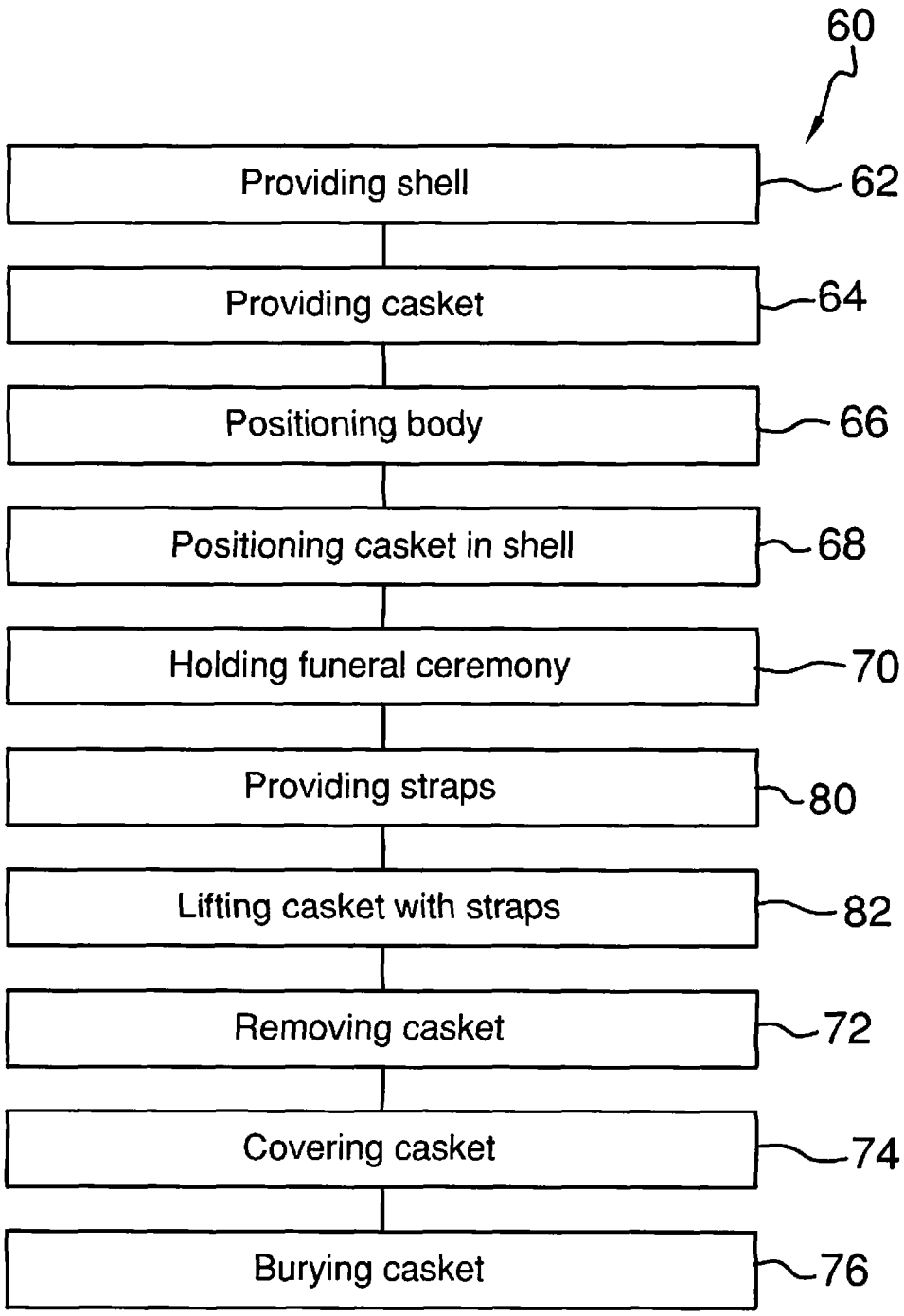
FIG. 6 is a schematic view of a method according to an embodiment of the disclosure.

With reference now to the drawings, and in particular to FIGS. 1 through 5 thereof, a new casket device embodying the principles and concepts of an embodiment of the disclosure and generally designated by the reference numeral 10 will be described.

As best illustrated in FIGS. 1 through 5, the casket shell assembly and method of enhancing casket appearance 10 generally comprises a casket 12 is constructed of a wood material or other inexpensive of environmentally friendly material depending on user preference or needs. A shell 14 has a perimeter wall 16, an open top 18, and an open bottom 20. The shell 14 is decorative and may be constructed of a durable material such as metal. The shell 14 is designed to have an opulent appearance and may also be constructed of more expensive materials including fine hardwoods or metals. The shell 14 is configured for receiving the casket 12 through the open top 18 to encase the casket 12 during a ceremonial funeral service. A lip 22 is coupled to and extends inwardly from an inner surface 24 of the perimeter wall 16 of the shell 14 whereby the lip 22 supports the casket 12 when the casket 12 is inserted into the shell 14 through the open top 18 of the shell 14. The casket 12 and shell 14 are complimentary so as to give a unified appearance that the shell 14 is the actual exterior of the casket 12.

A lid 26 is coupled to the perimeter wall 16. The lid 26 selectively covers the open top 18 of the shell 14 when the lid 26 is in a closed position 28. The lid 26 may have a first section 30 and a second section 32 covering respective portions of the casket 12 when the casket 12 is positioned in the shell 14. Each of the first section 30 and the second section 32 is pivotally coupled to a top edge 34 of the perimeter wall 16 of the shell 14. A plurality of straps 38 is positioned in the shell 14. The straps 38 are configured for extending between the shell 14 and the casket 12. Each of the straps 38 has opposite free ends 40 extendable through the open top 18 of the shell 14 whereby the straps 38 are configured for facilitating lifting of the casket 12 from the shell 14.

A casket lining 42 is coupled to and covers an interior surface 44 of the casket 12. A lid lining 46 is coupled to and covers an interior surface 48 of the lid 26. The lid lining 46 may have either a matching appearance relative to the casket lining 42 or a complimentary appearance such that the casket lining 42 and lid lining 46 give the appearance of a single unit when the casket 12 is positioned in the shell 14. A cover 50 may be provided to selectively couple to the casket 12 for burial after the casket 12 has been removed from the shell 14. A casket padding 52 may be coupled to the casket 12 and positioned between the casket 12 and the casket lining 42. Similarly, a lid padding 54 may be coupled to the lid 26 and positioned between the lid 26 and the lid lining 46. This again enhances the illusion of a single unit when the casket 12 is inserted into the shell 14 and further enhances the appearance for a funeral service prior to burial.

In use, the shell 14 and casket 12 provide for a desired appearance during a funeral ceremony while facilitating burial of an environmentally friendly or less expensive casket 12. The shell 14 is the more expensive item to produce and may be used repeatedly with new caskets 12. The assembly 10 provides for a method 60 of enhancing casket appearance for an economical expense. A first step 62 is providing the shell 14 and another step 64 is providing the casket 12 each as described above. Yet another step 66 is positioning a deceased body in the casket 12. Another step 68 is positioning the casket 12 in the shell 14 such that the casket 12 is supported on the lip 22 in the shell 14. Still another step 70 is holding a funeral ceremony while the casket 12 is positioned in the shell 14. A step 72 is removing the casket 12 from the shell 14. Still yet another step 74 is covering the casket 12 and a final step 76 is burying the casket 12 while the deceased body remains in the casket 12. An additional step 80 may be providing the plurality of straps 38 positioned in the shell 14 as described more fully above permitting a step 82 of lifting the casket 12 from the shell 14 using the straps 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A casket shell assembly comprising:

a casket including a cover;

a shell having a perimeter wall, an open top, and an open bottom, said shell being configured for receiving said casket through said open top;

a lip coupled to and extending inwardly from an inner surface of said perimeter wall of said shell whereby said lip supports said casket when said casket is inserted into said shell through said open top of said shell;

a lid coupled to said perimeter wall, said lid selectively covering said open top of said shell when said lid is in a closed position; and a plurality of straps positioned in said shell, said straps extending between said shell and the casket, each of said straps having opposite free ends extending through said open top of said shell whereby said straps facilitate lifting of the casket from said shell.

2. The assembly of claim 1, further including a casket lining coupled to and covering an interior surface of said casket.

3. The assembly of claim 2, further including a lid lining coupled to and covering an interior surface of said lid, said lid lining being complimentary to said casket lining.

4. The assembly of claim 2, further including a lid lining coupled to and covering an interior surface of said lid, said lid lining having a matching appearance relative to said casket lining.

5. The assembly of claim 2, further including casket padding coupled to said casket, said casket padding being positioned between said casket and said casket lining.

6. The assembly of claim 1, further including said lid having a first section and a second section, each of said first section and said second section being pivotally coupled to a top edge of said perimeter wall of said shell.

7. The assembly of claim 1, further including said shell being constructed of a metal material.

8. The assembly of claim 1, further including said casket being constructed of a wood material.

9. The assembly of claim 1, further including said cover being selectively couplable to said casket.

10. The assembly of claim 9, further including lid padding coupled to said lid, said lid padding being positioned between said lid and said lid lining.

11. The assembly of claim 1, further comprising:

said casket being constructed of a wood material;

said lid having a first section and a second section, each of said first section and said second section being pivotally coupled to a top edge of said perimeter wall of said shell;

a casket lining coupled to and covering an interior surface of said casket;

a lid lining coupled to and covering an interior surface of said lid, said lid lining having a matching appearance relative to said casket lining;

said cover being selectively couplable to said casket;

a casket padding coupled to said casket, said casket padding being positioned between said casket and said casket lining; and a lid padding coupled to said lid, said lid padding being positioned between said lid and said lid lining.

12. A method of enhancing casket appearance, the steps of the method comprising:

providing a shell having a perimeter wall, an open top, and an open bottom, a lip coupled to and extending inwardly from an inner surface of said perimeter wall of said shell, a lid being coupled to said perimeter wall, said lid selectively covering said open top of said shell when said lid is in a closed position, a lid lining coupled to and covering an interior surface of said lid;

providing a casket including a cover, a casket lining coupled to and covering an interior surface of said casket, said lid lining having a matching appearance relative to said casket lining;

positioning a deceased body in said casket;

positioning said casket in said shell such that said casket is supported on said lip in said shell;

holding a funeral ceremony while said casket is positioned in said shell;

providing a plurality of straps positioned in said shell, said straps extending between said shell and said casket, each of said straps having opposite free ends extending through said open top of said shell whereby said straps facilitate lifting of the casket from said shell;

lifting said casket from said shell using said straps;

removing said casket from said shell;

covering said casket with said cover; and burying said casket while said deceased body remains in said casket.

* * * * *